United States Patent [19]

Eckstein et al.

[11] Patent Number: 4,760,667

[45] Date of Patent: Aug. 2, 1988

[54] PROCESS AND APPARATUS FOR THE PREPARATION OF SYNTHESIS GAS

[75] Inventors: Gunter K. Eckstein; Kurt Schleyer, both of Hamburg, Fed. Rep. of Germany

[73] Assignee: Shell Oil Company, Houston, Tex.

[21] Appl. No.: 928,606

[22] Filed: Nov. 3, 1986

Related U.S. Application Data

[63] Continuation of Ser. No. 696,661, Jan. 30, 1985, abandoned.

[51] Int. Cl.[4] ..... C10J 3/54; C10J 3/56

[52] U.S. Cl. ..... 48/69; 48/197 R; 48/DIG. 2

[58] Field of Search ..... 48/DIG. 2, 63, 67, 69, 48/76, 77, 197 R, 202, 206, 209, 210, 87; 209/158, 162, 163; 55/228; 110/171

[56] References Cited

U.S. PATENT DOCUMENTS

| | | | |
|---|---|---|---|
| 3,295,677 | 1/1967 | Condolios | 209/158 |
| 3,554,371 | 1/1971 | Leonard | 209/158 |
| 3,994,702 | 11/1976 | Schweimanns et al. | 48/197 R |
| 4,074,981 | 2/1978 | Slater | 48/197 R |
| 4,220,469 | 9/1980 | Tippmer | 48/202 |
| 4,367,148 | 1/1983 | Fulton et al. | 55/228 |
| 4,508,542 | 4/1985 | Langhoff et al. | 48/77 |

FOREIGN PATENT DOCUMENTS

| | | | |
|---|---|---|---|
| 147347 | 4/1981 | Fed. Rep. of Germany | 209/162 |
| 805,658 | 12/1958 | United Kingdom | 209/158 |

*Primary Examiner*—Barry S. Richman
*Assistant Examiner*—Joye L. Woodard

[57] ABSTRACT

Process and apparatus for the preparation of synthesis gas by the partial combustion of a carbonaceous fuel with an oxygen-containing gas in a reactor also producing molten slag, the molten slag being removed through a slag discharge in the bottom portion of the reactor and being passed by gravity into a water bath where it is solidified by quenching. Solidified slag floating on the water of the water bath is removed therefrom by lowering the water level in the water bath to a location or point below the lower end of a baffle, the baffle being arranged in the water bath and dividing the water bath into an upper quenching zone and a lower capturing zone, and by raising the water level again to above the upper end of the baffle, thereby capturing floating slag under the baffle, the captured slag being discharged from the water bath through an outlet arranged at or near the top of the capturing zone.

10 Claims, 2 Drawing Sheets

PROCESS AND APPARATUS FOR THE PREPARATION OF SYNTHESIS GAS

This is a continuation of application Ser. No. 696,661, filed Jan. 30, 1985, now abandoned.

BACKGROUND OF THE INVENTION

The partial combustion of a carbonaceous fuel with substantially pure oxygen yields synthesis gas consisting mainly of carbon monoxide and hydrogen. When the oxygen is supplied as an oxygen-containing gas, such as air or oxygen-enriched air, the synthesis gas formed also contains a substantial quantity of nitrogen. As used herein, the term carbonaceous fuel includes coals, such as brown coal, peat, wood, coke, soot, and the like, and liquid fuels, such as tar sand oil, shale oil, and mixtures of these liquid and particulate solid fuels.

Preferably, a moderator is also introduced into the reactor. The object of the moderator is to exercise a moderating effect on the temperature in the reactor. This is ensured by endothermic reaction between the moderator and the reactants and/or products of the synthesis gas preparation. Suitable moderators include steam and carbon dioxide.

The gasification is preferably carried out at a temperature in the range of from 1200° to 1700° C. nd at a pressure in the range of from 1 to 200 bar.

The reactor in which the preparation of synthesis gas takes place may have the shape of a sphere, a cone, a block or a cylinder. Preferably, the reactor has the shape of a cylinder.

The supply of carbonaceous fuel and oxygen-containing gas can take place through the bottom of the reactor. It is also possible to supply one of the reactants through the bottom of the reactor and one or more others through the side wall of the reactor. However, both the fuel and the oxygen-containing gas and the moderator are preferably supplied through the side wall of the reactor. This is advantageously performed by means of at least two burners arranged symmetrically in relation to the reactor axis in a lower part of the side wall.

Part of the slag is entrained by the synthesis gas as small droplets and leaves the reactor therewith. Although the gas outlet through which the synthesis gas is discharged may be arranged at or near the bottom of the reactor, it is preferably situated at or near the top. The remainder of the liquid slag formed in the combustion reaction drops down and is drained through the slag discharge located in the reactor bottom.

To remove the slag from the gasifying process, it is known to arrange a cooling or quenching water bath at the bottom of the gasifying vessel, in which water bath the slag, descending due to its weight, is captured and quenched, slag granules or agglomerates being formed. The slag granules are periodically or continuously removed from the water bath by means of conventional arrangements. The slag is suitably discharged through a slag outlet at the bottom of the water bath. When the gasification reactor and water bath are at pressures above 1 bar, a sluicing vessel is advantageously provided under the water bath.

Part of the slag which is solidified by cooling or quenching keeps floating on the water of the water bath. Occasionally, from 1 to 80% wt of the slag, discharged through the slag discharge of the reactor, keeps floating. When the floating slag forms a relatively thick layer, it can prevent molten slag from falling into the water bath. Accordingly, it is desirable to remove the floating slag from the water before the layer gets too thick.

When the floating slag is removed by drawing-off all the water from the water bath through the slag outlet at the bottom of the water bath, hot molten slag will contact the valve or valves in the slag outlet and cause considerable damage to the valve or valves. The present invention seeks to overcome this problem.

SUMMARY OF THE INVENTION

Accordingly, the present invention relates to a process for the preparation of synthesis gas by the partial combustion of a carbonaceous fuel with an oxygen-containing gas in a reactor, also producing molten slag, the molten slag being removed through a slag discharge in the bottom portion or section of the reactor and being passed by gravity into a water bath where it is solidified by quenching, the process being characterized in that slag floating on the water of the water bath is removed therefrom by lowering the water level in the water bath to below the lower end of a baffle which is arranged in the water bath and divides the water bath into an upper quenching zone and a lower capturing zone, and by raising the water level again to above the upper end of the baffle, thereby capturing floating slag under the baffle, the thus captured slag being discharged from the water bath through an outlet arranged in the wall of the water bath at or near the top of the capturing zone.

The invention also relates to an apparatus for the partial combustion of a carbonaceous fuel with an oxygen-containing gas, the apparatus comprising a reactor which is equipped with a slag discharge in the bottom, the reactor debouching into a water bath vessel, the water bath vessel being provided with an interior baffle which divides the water bath vessel into an upper quenching zone and a lower capturing zone, means for lowering and raising the water level in the water bath vessel, and an outlet for floating slag and water in the wall of the water bath vessel at the top of the capturing zone.

The frequency of the lowering and raising procedure depends on the ash content of the carbonaceous fuel and/or the portion of the slag that keeps floating. It is possible to carry out this procedure only occasionally, as circumstances may require. It is also possible to carry out the procedure periodically.

The baffle is arranged so that, on one hand, it cover a sufficient part of the horizontal cross-section of the water bath to capture a substantial amount of the floating slag, when the water level is being raised, and on the other hand, it is not so large that it interferes with slag falling downwards. Therefore, the baffle preferably covers 50 to 95 percent of the horizontal cross section of the water bath.

The baffle can have various shapes. It is possible to use baffles which have the shape of a part of a cylinder wall, the convex side of the cylinder being directed upward. This way the baffle is "saddle"-shaped when the water bath is cylindrical itself, as it preferably is. The baffle can also be circular or semi-circular, such as the section or partial section of a sphere.

It is preferred that the baffle, at least for the major portion thereof, is flat, such as a flat circular or elliptical plate, and is placed obliquely in the water bath, since this involves a simple construction. To provide an optimal performance of the flat baffle, it is preferably placed at an angle from 20° to 70° to the axis of the water bath.

In another preferred embodiment, the baffle, at least for the major portion thereof, has the shape of a conical surface, the apex of which is directed upward and the apex angle of which is in the range of from 40° to 140°. The captured slag is discharged through the wall of the water bath via a conduit communicating with an outlet arranged at or near the apex or top of the conical surface. Although the conical surface is not necessarily coaxial with the water bath, it is preferred that the apex of the conical surface be situated on the center line of the water bath.

The baffle, preferably either flat or conically shaped, advantageously is provided with an edge member at its lower end, the edge member being preferably vertical.

Since the angle between the angle major part of the baffle, either flat or conically-shaped, and the axis of the water bath is between 20° and 70° in preferred embodiments, the risk of slag particles adhering to the baffle surface is rather small. The term "slag particles" refers to both the slag solidified in the quenching zone falling downward, and floating slag contacting the baffle when the water level is lowered.

Slag which nevertheless adheres to the baffle may suitably be removed, e.g., by vibrating the baffle. Advantageously, adhering slag is flushed away from the baffle. For this purpose, the baffle is preferably rinsed when the water level of the water bath has been lowered to a point below the lower end of the baffle. Also, for this purpose, preferably at least one nozzle, for the supply of rinsing water, is present in the wall of the water bath, preferably at a location above the upper end of the baffle. Rinsing the baffle not only flushes away the adhering slag, but also cools the baffle and the molten slag falling on to the baffle, the molten slag solidifying due to the cooling. In this way, the rinsing water protects the baffle against overheating.

The problem of slag adhering to the baffle may be circumvented when a flat baffle is arranged vertically during the period when the water level is still high. The passage of slag falling downwards will not be disturbed by the baffle. Therefore, in a preferred embodiment, the baffle is preferably arranged rotatably in the water bath, the baffle being rotatable around an axis in such a manner that it can be rotated from a vertical position to an oblique position wherein at least the upper end of the baffle contacts the wall of the water bath. When the water level is above the upper end of the baffle, the baffle is vertically positioned. When the water level has been lowered, the baffle is rotated such that it covers a substantial part of the horizontal cross-section of the water bath and contacts the wall of the water bath just above the outlet for floating slag. When the water level is raised the baffle is kept in the latter position. Not until the captured floating slag has been removed is the baffle rotated back into its original vertical position.

In a cylindrical water bath, the baffle has preferably the shape of an ellipse from which a lower segment has been cut-off, and the short axis of which is as long as the inner diameter of the water bath, the baffle being rotatable around said short axis. The baffle is suitable turned into an oblique position after the water level has been lowered to below the lower end of the baffle. The baffle being in this oblique position, molten slag falling from the reactor can pass through an opening provided by the cut-off segment. The surface area of the cut-off segment preferably represents 5 to 50% of the surface area of the ellipse.

As noted, the gasification suitably is carried out at a pressure in the range from 1 to 200 bar. The pressure of the gasification reactor also prevails in the water bath. When the gasification is carried out at about 1 bar, the floating slag and water discharged from the water bath can be passed directly to a separator, e.g. a filter, and the slag can be separated from the water. At higher pressures, the floating slag is preferably discharged into a receiving vessel from which the floating slag is removed, advantageously, periodically. Accordingly, a receiving vessel is preferably arranged next to the water bath, and a tube connects the outlet at the top of the capturing zone of the water bath with the receiving vessel.

Preferably, at least one tube connects the receiving vessel with the means for lowering and raising the water level in the water bath. Suitably, the water level in the water bath is lowered by passing water from the water bath into the receiving vessel and raised by passing water from the receiving vessel back into the water bath. In this way relatively little water will be needed for discharging the floating slag from the system. Possibly, the receiving vessel and the means for lowering and raising the water level in the water bath are connected by only one tube. The water is passed either way through this tube. Preferably, a tube is provided between the receiving vessel and the means for lowering the water level, and a separate tube between the receiving vessel and the means for raising the water level in the water bath.

Although the apparatus suitably comprises a receiving vessel when the gasification is carried out at pressures above 1 bar, it is also possible to apply a receiving vessel for atmospheric gasification processes.

BRIEF DESCRIPTION OF THE DRAWING

Reference is made to the accompanying schematic drawing. FIG. 1 illustrates the overall process scheme and apparatus of the invention, employing one type of baffle, while

DETAILED DESCRIPTION OF THE INVENTION

Figure 1:
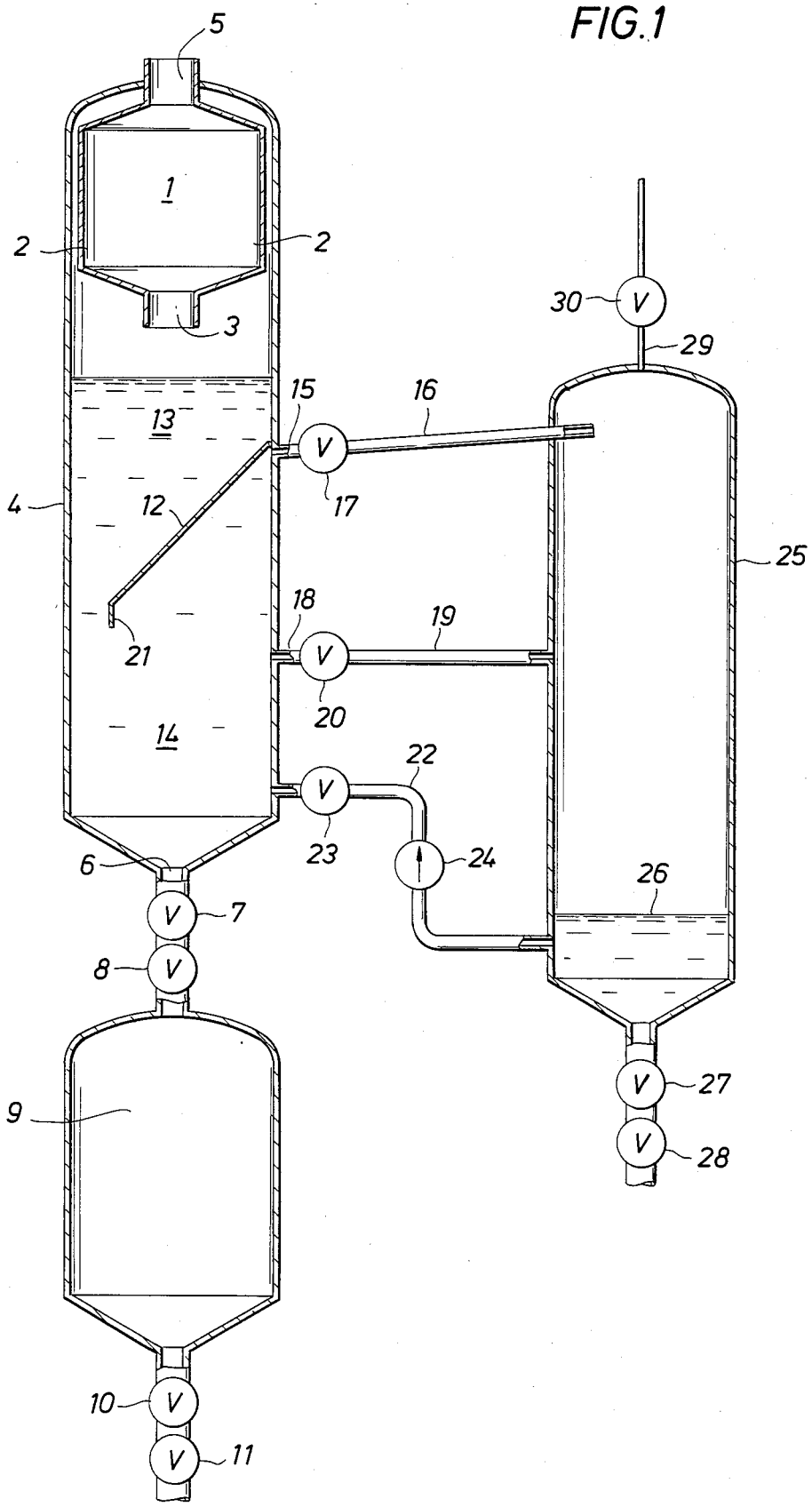

Referring to FIG. 1, a carbonaceous fuel, an oxygen-containing gas, and possibly a moderator, are introduced into reactor (1) via burners (2) positioned in the side wall of the reactor. The partial combustion yields synthesis gas and slag. The greater part of the liquid slag formed leaves the reactor via a slag discharge (3) in the bottom of the reactor (1). The synthesis gas flows upward and leaves the reactor (1) via a gas outlet (5) at the top of the reactor. The liquid slag drips down from the outlet (3) and falls into a cylindrical water bath (4) where it solidifies. Solid slag granules pass downward along a baffle (12), placed obliquely in the water bath and dividing the water bath into an upper quenching zone (13) and a lower capturing zone (14), the limitation of the zones being represented by the baffle (12). The slag passes through a slag discharge (6). Through valves (7) and (8) it is passed into a slag container (9) from which it is sluiced out via valves (10) and (11).

A part of the slag, especially porous slag particles and slag dust, keeps floating on the water of the water bath. Periodically, the water level in the water bath is lowered by opening a valve (20) in a line (19), and passing water via an outlet (18) through the line 19 into a receiving vessel (25). By lowering the water level, floating slag passes along the baffle (12) through the opening provided between the side wall of water bath (4) and a vertical edge member (21) of the baffle (12). When the water level has reached its lowest level, the valve (20) is closed. The lowest level of the water bath is suitably between the lower end of the edge (21) and the outlet (18). In this way the floating slag, after passage along the baffle, can spread over the entire cross section of the water bath, without the risk that the outlet (18), the valve (20) and the line (19) are polluted with slag. Subsequently, valves (17) and (23) are opened, and with the aid of a pump (24), water is pumped from the receiving vessel (25) through a line (22) into the capturing zone so that the water level rises. The major portion of the floating slag is captured under the baffle (12), and is passed via outlet (15) through line (16) into the receiving vessel (25). The line (16) is preferably sloped upward to facilitate the passage of the floating slag. When the water level has reached just above the upper end of the baffle, the valve (17) is closed, and when the water level has reached the desired upper level, the valve (23) is closed and the pump (24) is stopped. In the receiving vessel (25), a little water remains (designated by the dotted line 26). Slag floating on the water in the receiving vessel (25) may occasionally be sluiced out thereof via valves (27) and (28).

When the gasification reactor is operated at higher pressures, the receiving vessel is suitably provided with a pressure control means. Before the floating slag is sluiced out of the receiving vessel (25), the pressure prevailing in the receiving vessel (25) is lowered to atmospheric by venting gas through a line (29) by opening a valve (30). After the discharging of the floating slag from the receiving vessel, the pressure therein is increased by introduction of a gas under increased pressure through the line (29) into the vessel. The pressure in the receiving vessel is not necessarily equal to the pressure prevailing in the water bath; the former pressure may be somewhat lower than the latter pressure. By so doing, the water passes more quickly into the receiving vessel on the opening of valve (20). By opening valve (20), both pressure are equalized. After closure of the valves (20) and (23), the pressure can be lowered again in order to sluice out the floating slag.

Figure 2:
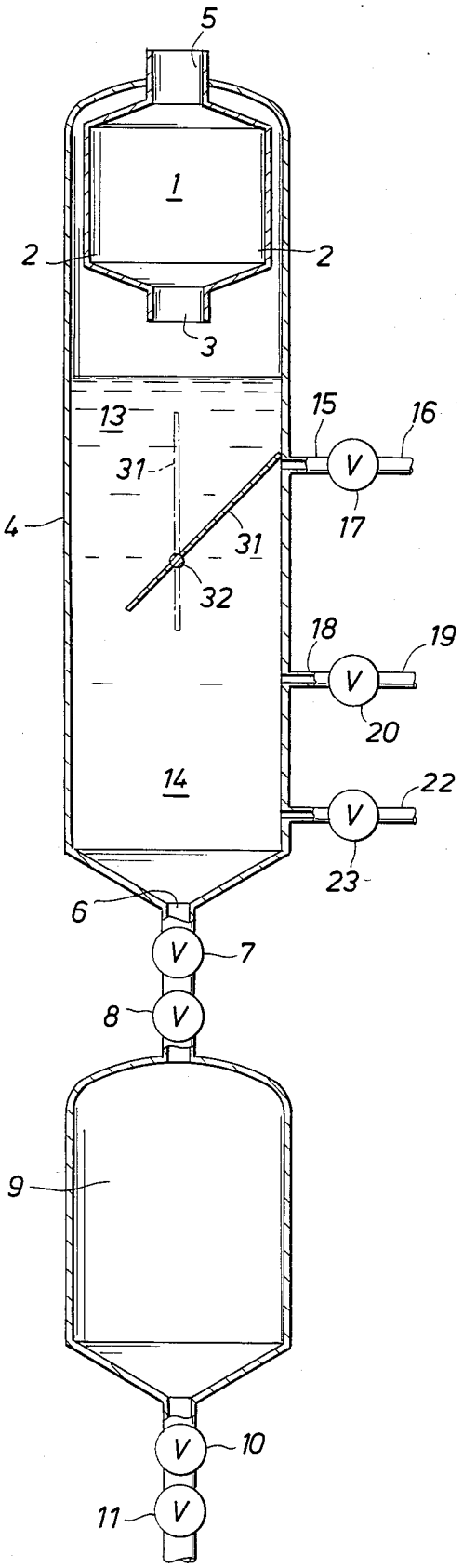
FIGS. 2 and 3 illustrate other baffle structures. Control and regulating devices, cooling systems, insulation, and the like, are not shown.

In FIG. 2, an apparatus is shown in which the fixed baffle (12) has been replaced by a rotatably arranged baffle (31). The baffle has the shape of a large segment of an ellipse, or an ellipse from which a segment has been cut off. The baffle is rotatable around the short axis, designated by (32).

In operation, when floating slag is collected on the water surface, the baffle is placed in a vertical position (shown by the dotted line). Slag which sinks is not hindered by the baffle. When the floating slag is to be removed, the water level is lowered by passing water through the line (19), and the baffle is turned into the oblique position, as shown in FIG. 2. After opening of valves (23) and (17), floating slag in the capturing zone (defined by the baffle in the oblique position) is captured by the baffle on raising the water level by passing water into the capturing zone through the line (22). After removal of the floating slag through the line (16), the water level is raised to the desired maximum level and the baffle is turned into its former vertical position.

Figure 3:
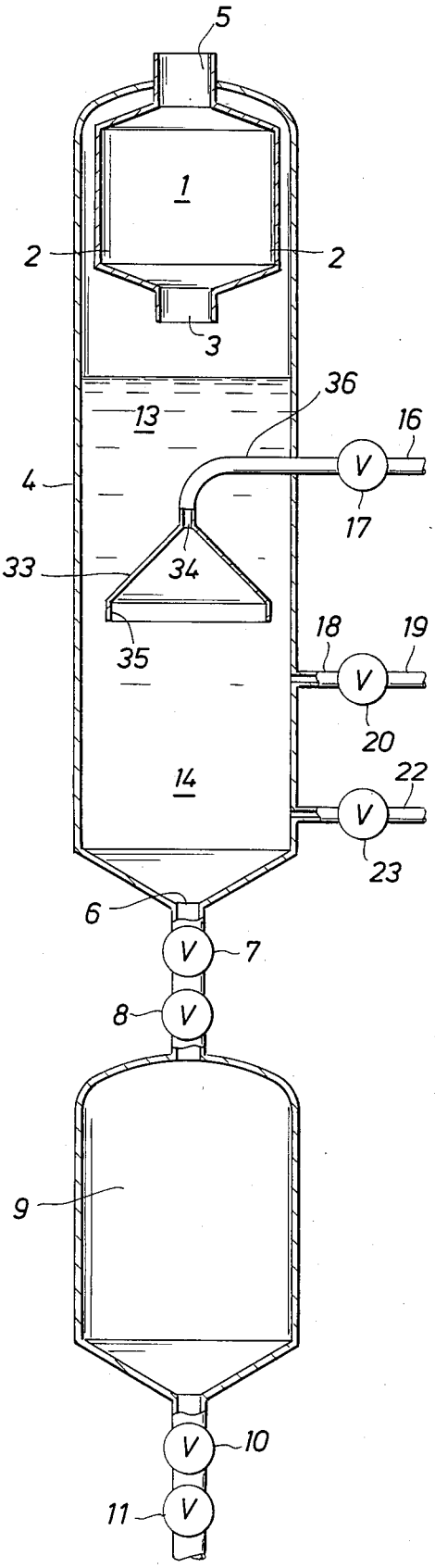

In FIG. 3, an embodiment is shown in which a conically-shaped baffle (33) is provided with an edge member (35). The captured slag is discharged through an outlet (34) at the top of the conically-shaped baffle, which outlet is connected with the line (17) by means of a tube (36).

What is claimed is:

1. A process for the preparation of synthesis gas comprising partially combusting a carbonaceous fuel with an oxygen-containing gas in a reactor, producing synthesis gas and molten slag; removing molten slag through a slag discharge in the bottom portion of the reactor and passing the slag by gravity into a water bath where it is solidified by quenching; removing slag floating on the water of the water bath by lowering the water level of the water bath to a level below the lower end of a baffle, the baffle being arranged in the water bath and dividing the water bath into an upper quenching zone and a lower capturing zone, and by raising the water level again to above the upper end of the baffle to capture floating slag under the baffle; and discharging captured slag from the water bath through an outlet arranged at or near the top of the capturing zone.

2. The process of claim 1 in which the baffle covers 50 to 95 percent of the horizontal cross section of the water bath.

3. The process of claim 2 in which the baffle is flat for at least a major portion thereof and at least the flat portion is placed obliquely in the water bath.

4. The process of claim 2 in which the baffle has, for the major portion thereof, the shape of a conical surface, the apex of which is directed upward and the apex angle of which is in the range from 40° to 140°, and in which the captured slag is discharged through an outlet at or near the apex of the conical surface and thence through a conduit communicating with an opening in the wall of the water bath.

5. The process of claim 2 in which the baffle is rotatable and has the shape of a segment of an ellipse which is rotated from a vertical position to an oblique position after the water level of the water bath has been lowered to below the lower end of the baffle to divide the water bath into said upper quenching and lower capturing zones.

6. An apparatus for the partial combustion of a carbonaceous fuel with an oxygen-containing gas comprising a reactor which is equipped with a slag discharge in the bottom; a water bath vessel, said water bath vessel positioned so that molten slag from the reactor may be removed through said slag discharge and passed by gravity into the water bath vessel, the water bath vessel being provided with an interior baffle which divides the water bath vessel into an upper quenching zone and a lower capturing zone; means for lowering and raising the water level in the water bath vessel; and an outlet for floating slag and water in the wall of the water bath vessel at or near the top of the capturing zone.

7. The apparatus of claim 6 in which the baffle covers 50 to 95 percent of the horizontal cross section of the water bath.

8. The apparatus of claim 7 in which the baffle is flat over at least a major portion thereof and at least the flat portion is placed obliquely in the water bath.

9. The apparatus of claim 7 in which the baffle has, for a major portion thereof, a conically shaped surface, the apex of which is directed upward and the apex angle of which is in the range from 40° to 140°, the conical surface being provided with an opening at or near the apex which communicates, via a conduit, with said outlet in the wall of the water bath vessel.

10. The apparatus of claim 6 in which the baffle has the shape of an ellipse, and the baffle is rotatable in the water vessel.

* * * * *